US006694527B1

(12) United States Patent
Vega Garcia

(10) Patent No.: US 6,694,527 B1
(45) Date of Patent: Feb. 24, 2004

(54) FUN CAP WITH A MOTOR

(76) Inventor: Vicenta Vega Garcia, Espiritu Santo, 9 - 1A, Valladolid (ES)

( * ) Notice: Subject to any disclaimer, the term of this patent is extended or adjusted under 35 U.S.C. 154(b) by 103 days.

(21) Appl. No.: 09/831,858

(22) PCT Filed: Sep. 14, 2000

(86) PCT No.: PCT/ES00/00348

§ 371 (c)(1),
(2), (4) Date: May 15, 2001

(87) PCT Pub. No.: WO01/21020

PCT Pub. Date: Mar. 29, 2001

(30) Foreign Application Priority Data

Sep. 22, 1999 (ES) ..... 9902416 U

(51) Int. Cl.[7] ..... A42B 1/24; A63H 33/00
(52) U.S. Cl. ..... 2/209.13; 2/195.1; 446/27
(58) Field of Search ..... 2/209.13, 195.1; 446/26, 27; 40/414, 419

(56) References Cited

U.S. PATENT DOCUMENTS

| | | | | | |
|---|---|---|---|---|---|
| 1,475,222 | A | * | 11/1923 | Converse | 40/419 |
| 4,268,918 | A | | 5/1981 | Lee | 2/199 |
| 4,488,372 | A | * | 12/1984 | Lowen | 446/27 |
| 4,586,280 | A | | 5/1986 | Dane | 40/329 |
| 4,658,446 | A | | 4/1987 | McGill | 2/209 |
| 4,729,747 | A | * | 3/1988 | Yeh | 446/27 |
| 4,832,647 | A | | 5/1989 | Perlman | 446/27 |
| 5,088,127 | A | * | 2/1992 | Thornock | 2/209.13 |
| 5,167,559 | A | | 12/1992 | Power-Fardy | 446/27 |
| 5,413,355 | A | * | 5/1995 | Gonzalez | 273/429 |
| 5,462,471 | A | * | 10/1995 | Power-Fardy | 446/26 |
| 6,039,625 | A | * | 3/2000 | Wang | 40/414 |
| 6,167,570 | B1 | * | 1/2001 | Su | 2/209.13 |
| 6,438,760 | B1 | * | 8/2002 | Wakefield et al. | 2/209.13 |

FOREIGN PATENT DOCUMENTS

| | | |
|---|---|---|
| ES | 0290411 | 3/1986 |
| ES | 0289264 | 4/1986 |
| ES | 0292418 | 6/1986 |
| ES | 1001744 | 5/1988 |
| ES | 1020202 | 6/1992 |
| ES | 1022411 | 4/1993 |

* cited by examiner

*Primary Examiner*—Rodney M. Lindsey
(74) *Attorney, Agent, or Firm*—Ladas & Parry

(57) ABSTRACT

This invention consists of a cap with a visor provided with two hands in the front which move automatically, that can be used for entertaining and promotional purposes.

4 Claims, 2 Drawing Sheets

FUN CAP WITH A MOTOR

OBJECT OF THE INVENTION

This invention is based on a standard cap incorporating a variant of automated movement for any kind of promotional use.

BACKGROUND OF THE INVENTION

Many different sorts of caps are used for promotional purposes, with or without movement, but no one has ever heard of a cap incorporating a fully automatic clapping function.

DESCRIPTION OF THE INVENTION

In a cotton canvas cap with a visor, baseball-type, two protruding moving elements are fitted into the seams of the 2 front panels on each side of the bill and parallel to the edges of the visor. This item is to be considered as a fun cap, perfect for promotional use.

The moving elements are made up of two pieces of fabric sewn together face to face, forming a bag padded with foam or another material in order to give it consistency and simulate a hand or another shape depending on the intended promotional use (see drawing # 2).

Another piece of mesh fabric is sewn inside the two front panels for proper ventilation of the user's forehead. Between the front panels and the mesh fabric, a U-shaped plastic (polycarbonate) strip is fitted, the arms of which come out of the seams on each side of the front; these two inserts are sandwiched into the tip of the moving parts to maintain them stiff and roughly horizontal, acting also as a return spring when a clapping movement is simulated.

Figure 1:
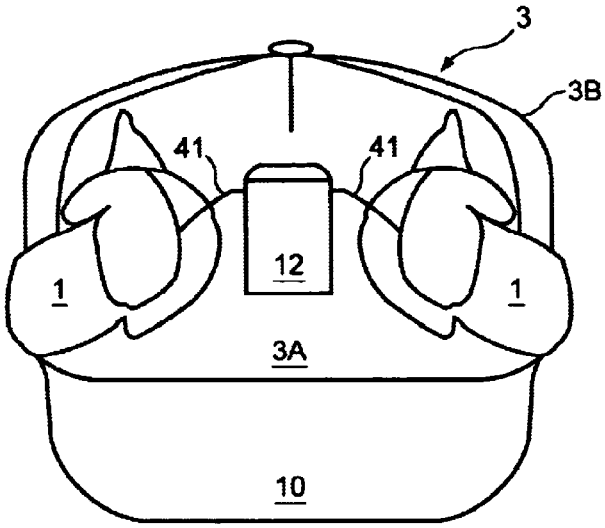
Figure 2:
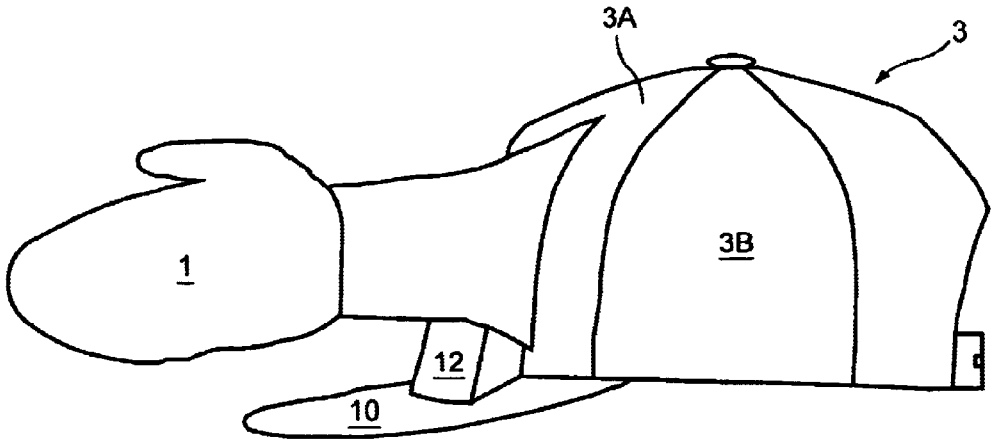
Figure 3:
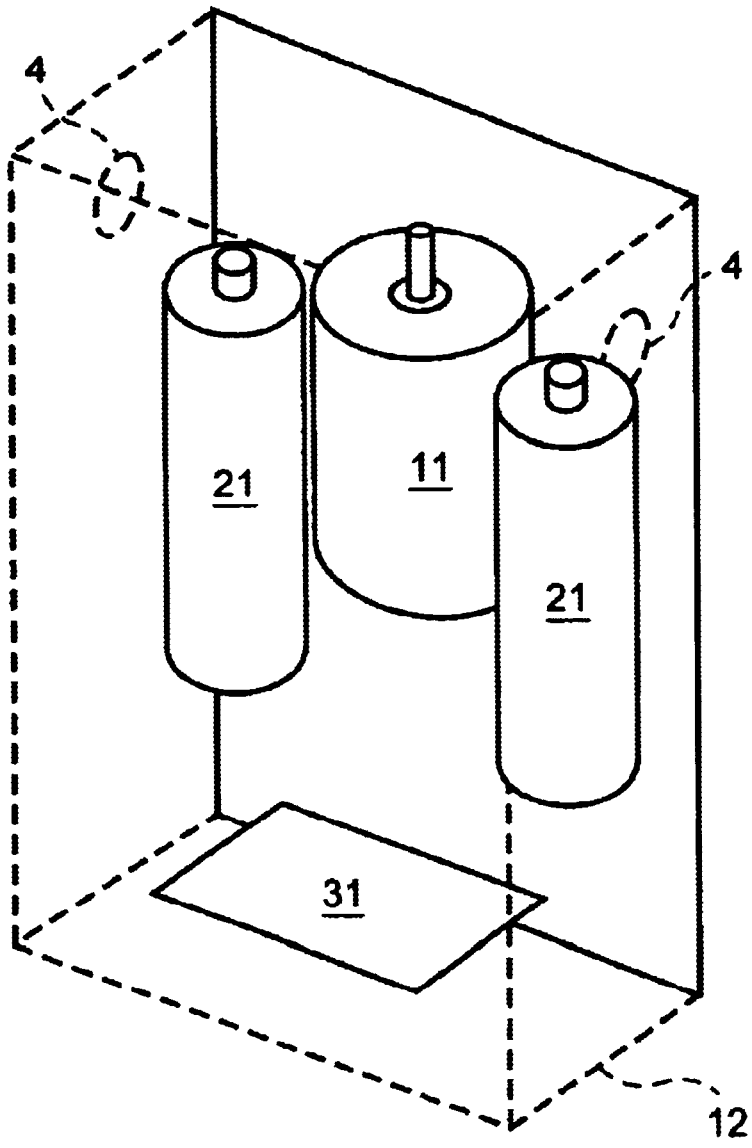

Above (FIG. 1) or on the top of (FIG. 2) the visor 10, a small box 12 housing the mechanism 11 (FIG. 3) for actuating the moving parts 1 (FIG. 1), the batteries 21 (FIG. 3) and the printed circuit 31 (FIG. 3) is fitted between the moving parts 1, which are a pair of hand shapes fastened to the front 3A of the crown 3B of the cap 3.

The actuation is provided by a miniaturized electric D.C. motor such as those used in toys. Pulses are delivered by an electronic device to the motor with a view to simulating the clapping action—if the moving parts are hands—or putting into motion the element used for promotional purposes.

The clapping movement is achieved by using nylon threads 41 each fastened to a moving element 1 (hands or whatever) on one end and, through holes 4 on opposite sides of the mechanism box 12 to wind up onto the shaft of the motor 1 at the other end. When the motor is energized, the threads wind up and when it is de-energized, the threads unwind and the hands open out due to the elastic spring effect produced by a polycarbonate inside the moving parts 1.

The path of the moving elements is limited by the nylon threads of sufficient diameter to overcome the strength applied by the plastic strip inserted in the cap and the advertising element.

The control electronics is based on a microcontroller that regulates the number of times the motor is energized and de-energized. The microcontroller also regulates the number of clapping cycles each time the mechanism is operated, i.e. the pre-determined sequence of cycles—according to the advertising company's specifications—which is completed before the mechanism stops automatically leaving the motor and the moving parts in rest position.

Initially, the solution chosen for actuating the mechanism is a membrane-type switch fitted on the edge of the visor. Further developments might feature a microphone for voice-actuation.

The energy required for the clapping movement is provided by two dry cell batteries (1.5 v) located inside the box that can be accessed easily by opening the snap-on tab of the box lid.

Attached is a number of diagrams to help understand the operation and the location of the different elements.

What is claimed is:

1. Motor-powered fun cap comprising:

a cap with a crown and a visor;

an electric motor;

two moving elements spaced on the crown above the visor; and a mechanism powered by the electric motor for moving the moving elements, the mechanism including an element acting as a return spring inside the moving elements also for rigidity and positioning.

2. Motor-powered fun cap according to claim 1, wherein to transmit the movement from the electric motor to the moving elements, the mechanism consists of two nylon threads fastened to the moving element and to the electric motor for winding up onto a shaft to bring the moving elements closer and when the electric motor stops, unwinding due to pulling exerted by the spring.

3. Motor-powered fun cap according to claim 2, and further comprising a printed circuit housed inside box on a front of the crown on top of or above the visor to energized and de-energize the electric motor.

4. Motor-powered fun cap according to claim 1, and further comprising a printed circuit housed inside box on a front of the crown on top of or above the visor to energized and de-energize the electric motor.

* * * * *